United States Patent [19]

Hanson, Jr. et al.

[11] Patent Number: 4,463,663

[45] Date of Patent: Aug. 7, 1984

[54] HYDRAULIC CYLINDER ASSEMBLY WITH A LIQUID RECOVERY SYSTEM

[76] Inventors: Wallace A. Hanson, Jr.; Russell B. Hanson, both of 94 Valley Hill Rd., Riverdale, Ga. 30274

[21] Appl. No.: 428,249

[22] Filed: Sep. 29, 1982

[51] Int. Cl.[3] ..... F15B 21/04

[52] U.S. Cl. ..... 92/80; 92/82; 92/86; 92/168

[58] Field of Search ..... 92/80, 82, 86, 168

[56] References Cited

U.S. PATENT DOCUMENTS

| | | | |
|---|---|---|---|
| 1,787,700 | 1/1931 | Persons | 92/86 |
| 3,369,411 | 2/1968 | Hines | 92/168 |
| 4,017,214 | 4/1977 | Smith | 92/80 |
| 4,154,434 | 5/1979 | Wallis | 92/158 |

FOREIGN PATENT DOCUMENTS

| | | | |
|---|---|---|---|
| 7402817 | 1/1974 | France | 92/168 |

*Primary Examiner*—Robert E. Garrett
*Assistant Examiner*—Scott L. Moritz
*Attorney, Agent, or Firm*—Newton, Hopkins & Ormsby

[57] ABSTRACT

A compressible bellows surrounds a piston rod of the hydraulic cylinder of a hydraulic elevator. The lower end of the bellows surrounds a liquid receiving recess in the gland box of the cylinder and, when a sealing ring on the piston rod closes and compresses the bellows, the leaked hydraulic fluid is discharged from the recess, via a ball check valve, and a return tube to a sump.

11 Claims, 4 Drawing Figures

HYDRAULIC CYLINDER ASSEMBLY WITH A LIQUID RECOVERY SYSTEM

BACKGROUND OF THE INVENTION

1. Field of the Invention

This invention relates to a hydraulic cylinder assembly with a liquid recovery system and is more particularly concerned with a hydraulic fluid recovery system for the hydraluic cylinder of a hydraulic elevator.

2. Description of the Prior Art

In the past, elevators or lifts which move only a few floors have been operated by hydraulics through the use of long piston rods connected to the bottoms of the elevator cars and retractable and extendable in hydraulic cylinders. Usually there is some leakage of the hydraulic fluid around the piston at the packing gland or gland box, such leaked liquid, in the past, has been drained to an open can which is emptied, periodically. At times, of course, the hydraulic fluid spills onto the floor supporting the hydraulic cylinder.

In the prior art is the patent to Persons, U.S. Pat. No. 1,787,700 which disclose a recriprocating piston and piston rod for a pump, the piston rod being enclosed by a bellows surrounding the piston rod. One end of the bellows is reciprocated by the piston and the other end is connected to a stationary cap. A passageway leads from the low pressure side of the piston to the bellows and a bleeder passageway leads from this low pressure side through a ball check valve which permits fluid from the low pressure side to be received in an intake passageway during an intake stroke of the piston. A second ball check valve permits discharge by the piston of this fluid into the discharage pipe when the piston is recriprocated. The Persons structure is not suitable for pistons having a long stroke or for hydraulic pistons which act as motors, rather than pumps and in which no vacuum is drawn on the high pressure side of the piston.

SUMMARY OF THE INVENTION

Briefly described, the present invention includes a hydraulic elevator car moveable in an elevator shaft and actuated by an upstanding cylinder mounted in conventional fashion in a concrete pit floor. The upper end of the cylinder receives for recriprocation a tubular piston, the upper end portions of which protrude through a gland box at the upper, i.e., outer, end of the cylinder and carries a platen plate and support channels which support the floor of the elevator car.

Surrounding the cylinder is a pressure generating bellows, the upper end of which journals, for axial movement, the piston, while the lower end portion is secured to the gland box of the cylinder. This gland box includes a fluid or oil collecting annular cup which communicates through a check valve with a tube or conduit leading back to the oil reservoir.

The bellows is normally opened at its upper end and stands at a normal prescribed height while the piston travels within the bellows. A sealing or cap ring, fixed at the upper end or distal end of the piston rides upwardly and downwardly with the piston and is adapted, as it approaches bottom dead center, to engage the open upper end of the bellows and thereby seal it so as to compress the bellows and thus compress the air therein upon continued retraction of the piston. The compressed air, in turn, acts upon the hydraulic fluid, overcoming the check valve, and causes any excess oil or hydraulic fluid to be discharged through the check valve and returned to the sump.

Accordingly, it is an object of the present invention to provide a hydraulic cylinder assembly with a liquid recovery system which is inexpensive to manufacture, durable in structure and efficient in operation.

Another object of the present invention is to provide a hydraulic cylinder assembly with a liquid recovery system which will effectively return any leaked liquid, i.e., oil or hydraulic fluid to the oil or hydraulic sump.

Another object of the present invention is to provide a hydraulic cylinder assembly with a liquid recovery system which will operate automatically, without external power and without requiring periodic inspection.

Another object of the present invention is to provide a hydraulic cylinder assembly with a liquid recovery system which will maintain the oil in a fresh condition, essentially free from any contamination by water or dirt.

Another object of the present invention is to provide a hydraulic cylinder assembly with a liquid recovery system which will protect the top portion of the piston from rusting.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENTS

Figure 1:
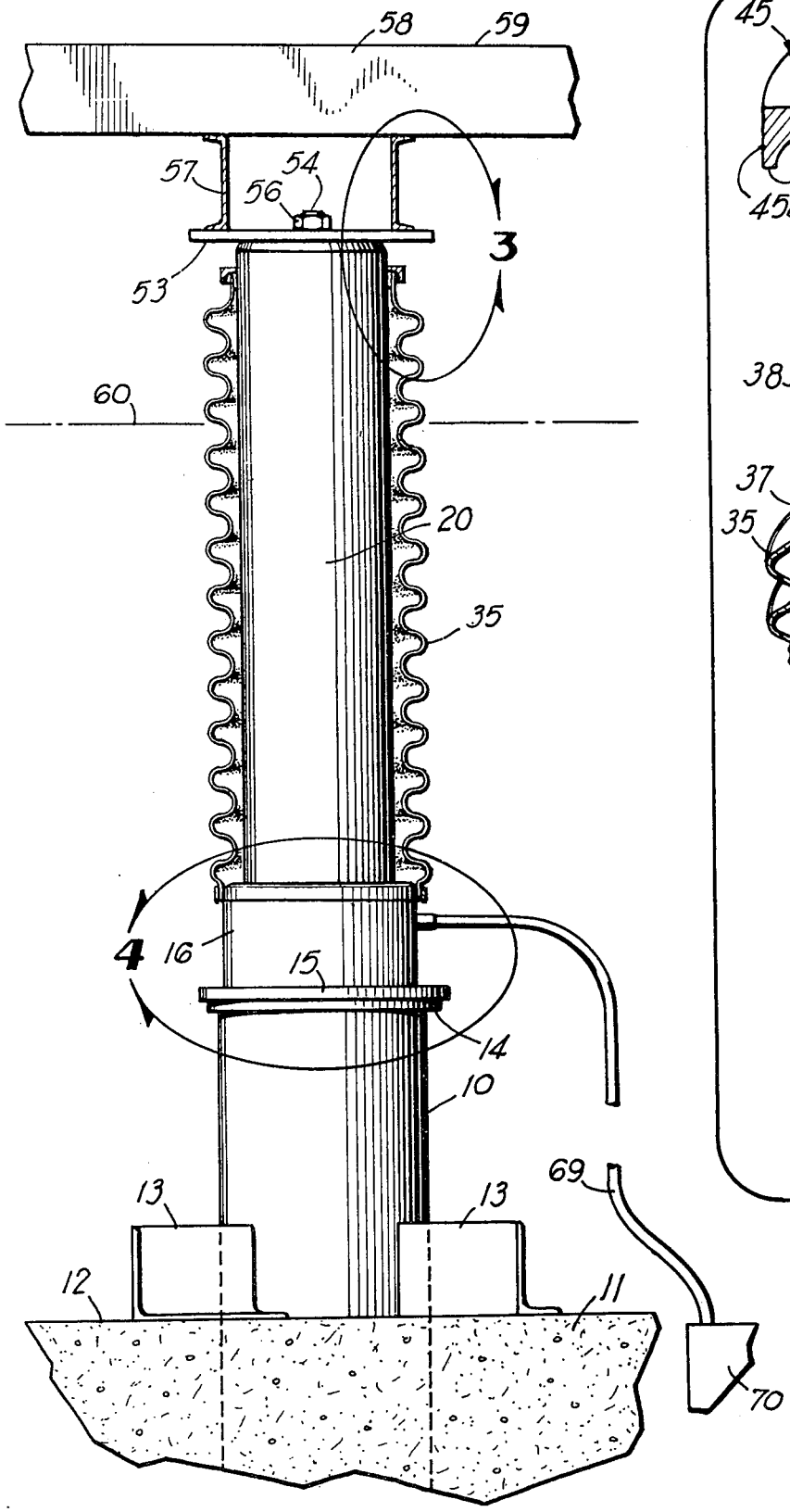
FIG. 1 is a vertical sectional view of a hydraulic elevator having a cylinder assembly with a liquid recovery system, constructed in accordance with the present invention.

Referring now in detail to the embodiment chosen for the purpose of illustrating the present invention, numeral 10 in FIG. 1 denotes a conventional upright or vertical hydraulic cylinder, the lower end portion of which is recessed into the concrete pit floor 11 of an elevator shaft, the upper end portion of the cylinder 10 projecting above the surface 12 of the floor 11. Reinforcing struts 13 secure the cylinder 10 in place. The upper end of the cylinder 10 is provided with a radially extending butt flange 14 on which is mounted an annular bottom plate 15 of a cylindrical packing gland or gland box 16.

Figure 4:
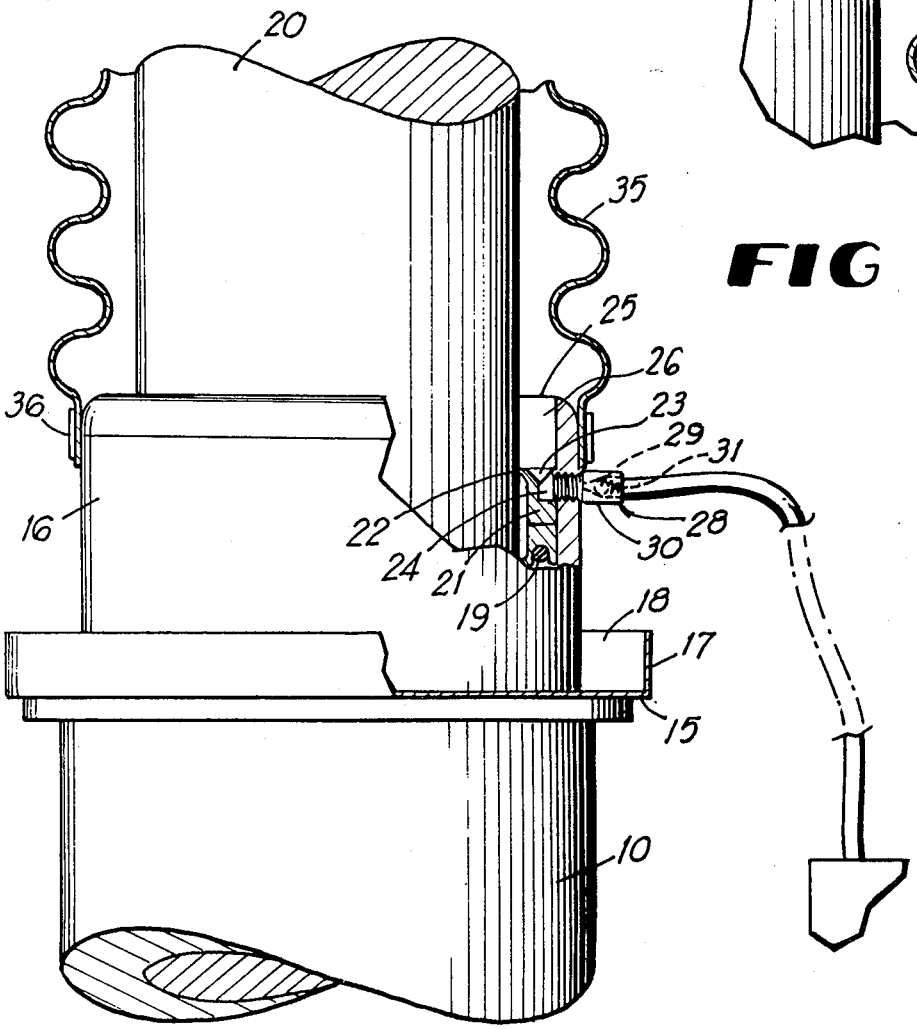
FIG. 4 is an enlarged fragmentary vertical sectional view taken substantially along line 4—4 in FIG. 1.

This bottom plate 15, as best seen in FIG. 4, is of larger outside diameter than the gland box 16 and its outer periphery has an annular upstanding flange 17. Flange 17 is concentric with the gland box 16 so as to provide, with the outer periphery of the plate 15 and the gland box 16, an annular liquid overflow receiving cup 18 which is U-shaped in cross-section and opens upwardly, circumscribing the lower portion of gland box 16.

A cylindrical piston rod 20 is concentrically received in the cylinder 10, the outer end portion of piston rod 20 protruding through the gland box 16 and upwardly, i.e., outwardly therefrom. The piston rod 20 and cylinder 10 form a conventional single acting cylinder assembly of a hydraulic elevator in which hydraulic fluid, liquid or oil is introduced into cylinder 10 in order to lift or extend piston rod 20 and is bled from the cylinder 10 when the piston rod 20 is to be retracted or lowered.

The gland box 16 is a hollow, tubular member disposed concentrically about the piston rod 20, the inside diameter of the gland box 16 being larger than the diameter of the piston 20 so as to provide an annular space, therebetween. Conventional packing 19 is received in the gland box and a resilient packing ring 21 is provided for retaining the packing 19 in place. The purpose of the packing 19, of course, is to substantially restrict hydraulic fluid, i.e., liquid hydraulic oil from leaking past the ring 21 and spilling outside of the cylinder 10. The upper edge of the ring 21 is provided with an inwardly extending annular wiper lip 22. Outwardly of lip 22, ring 21 is provided with a circumferential, annular, upwardly opening, V-shaped groove 23. A downwardly extending channel 24 in ring 21 adjacent to the inner surface of box 16, communicates with groove 23 of ring 21.

When the ring 21 is appropriately mounted in the gland box 16, it is spaced below the upper edge 25 of the gland box 16 so that the piston 20 and the inner periphery of the gland box 16 form a primary annular upwardly opening U-shaped liquid or oil receiving recess or cup 26, the bottom portion of which is defined by the V-shaped groove 23. A side portion of the gland box 16 is provided with a radially extending hole which threadedly receives the inner end of a ball check valve assembly 28. This ball check valve assembly 28 includes a ball 29 seated against a seat formed by the body 30 of the valve 28. The ball 29 is spring loaded inwardly by spring 31 for seating against the seat which is disposed inwardly of the ball 29.

Concentrically surrounding the piston rod 20 and extending above the gland box 16, is a tubular, cylindrical pressure generating bellows 35 which has an inside diameter slightly greater than the diameter of the piston rod 20. The pressure generating bellows 35 is formed of flexible elastomeric material and includes axially spaced alternate large diameter and smaller concentric diameter rings which are joined together so that the bellows 35 may be compressed in an axial direction for confining air between the piston 20 and bellows 35. When released the bellows 35 is sufficiently resilient that it returns to its original position, as depicted in FIG. 1 and FIG. 4.

The lower end of the bellows 35 is cylindrical, is fitted over the upper end portion of the gland box 16, as seen in FIGS. 1 and 4, and is retained in place by a clamp or compression ring 36 which extends over the lower end portion of the bellows 35 and firmly clamps the lower end portion of bellows 35 between the clamp 36 and the upper outer peripheral portion of the gland box 16.

Figure 2:
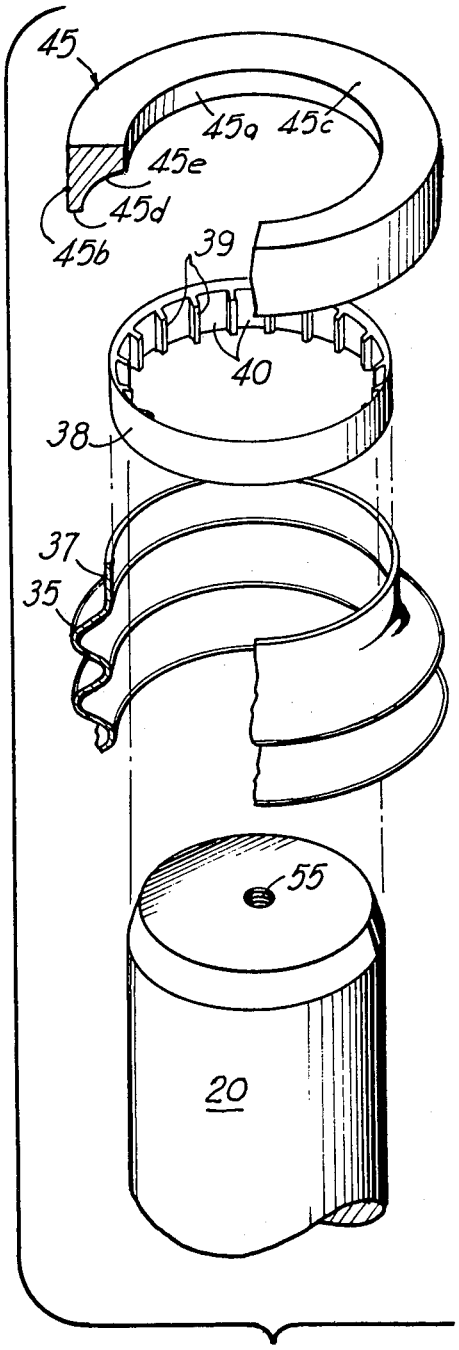
FIG. 2 is a fragmentary exploded perspective view of the upper end portion of the piston of the structure depicted in FIG. 1.
Figure 3:
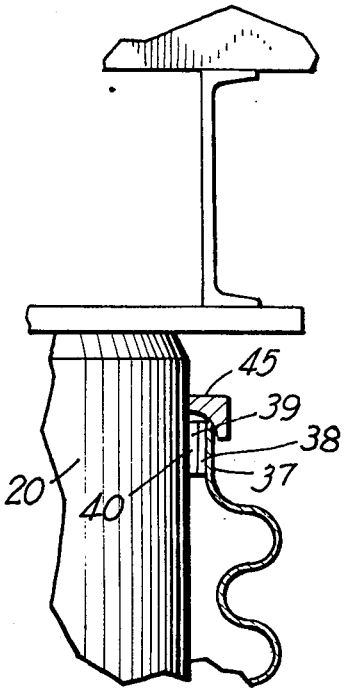
FIG. 3 is an enlarged fragmentary perspective view taken substantially along line 3—3 in FIG. 1.

As best seen in FIG. 2, the upper or outer end of the bellows 35 is also provided with a cylindrical end portion, denoted by numeral 37, which is received on a relatively rigid spacer ring 38. The spacer ring 38 has a cylindrical outer surface, on which the end portion 37 is received, and a cylindrical inner surface, the inner surface being larger in diameter than piston rod 20. Circumferentially spaced radial teeth 39 protrude inwardly from ring 38 and terminate so as to define a diameter approximately equal to the diameter of the piston rod 20. The spacer ring 38 is slideably received on the piston rod 20, as seen in FIG. 3 and, therefore, provides a plurality of air passageways 40 by means of which the interior of the bellows 35 communicates with the ambient air and is under atmospheric pressure during a major portion of the travel of the piston rod 20. Preferably the ring 38 is made of plastic and the inner ends of the teeth 39 loosely engage the piston rod 20 so that the piston rod 20 is free to move axially within the ring 38 and so that it can be extended to any distance without elongating the bellows 35.

At the upper end portion of the piston rod 20, there is provided a sealing ring 45 which circumscribes the upper end portion of the piston rod 20 and is fixed thereto for traveling with the piston rod 20 as it travels up and down. In more detail, the sealing ring 45 includes an inner cylindrical surface **45*a*, an outer cylindrical surface 45*b* concentric with the inner surface 45*a*. Ring 45 also has a flat, radially extending, upper surface 45*c*. The bottom outer surface 45*d* adjacent the outer periphery or surface 45*b*, is flat and parallel to surface 45*c*; however, the inner portion of the bottom surface, at numeral 45*e*, is concaved, curving upwardly and inwardly to provide an annular concaved camming surface. The major diameter of the sealing ring 45 is greater than the diameter of the spacer ring 38 and the end portion 37** thereover.

The piston rod 20 is substantially longer than and has a stroke axially which is many times the length of bellows 35. Therefore, during most of the travel of the piston rod 20, the bellows 35 remains open to the atmosphere. As the piston rod 20 is retracted, moving downwardly to about its lowermost position, the concaved camming surface **45*e* of sealing ring 45 engages and is received over the upper end portion of the spacer ring 38 to center it and close its upper end portion 37 to the atmosphere. At that stage, an air tight seal is provided by surface 45*e* for the upper end of bellows 35 and, upon further retraction of travel of the piston rod 20 into cylinder 10, the sealing ring 45 urges the upper end portion 37 downwardly and compresses the bellows 35. This causes a progressive compressing of the air in bellows 35 and a build up of air pressure between the bellows 35 and the piston rod 20, which upon further travel of piston rod 20 will be sufficient to unseat the ball 29 of the check valve 28 to release the excess pressure. If any oil or hydraulic liquid or fluid has been collected in the recess or cup 26, the air pressure will force the oil through the passageway 24 and, thence, out through the ball check valve 28. A tube 69 connected to the ball check valve 28 delivers this fluid back to a sump 70. The sump tank 70 need not be below the ball check valve 28 since the pressure generated by bellows 35** will lift the liquid.

At the upper end of the piston rod 20, there is provided a flat platen plate 53 which is secured to the upper surface of the piston rod 20 by means of an axial bolt 54 which is threadedly carried by a hole 55 in the upper end of the piston rod 20, the bolt 54 being provided with a nut 56. Supported by the platen plate 53, are support channels 57 which, in turn, support the car floor 58 of an elevator or car which travels in the elevator shaft.

When the elevator is lowered to the bottom landing, the upper surface 59 of the floor 58 is aligned with the upper surface of the finished floor, denoted generally by broken line 60. In such a condition of the elevator, the bellows 35 is compressed sufficiently that the air pressure generated, should overcome the ball check valve 28. This air presssure should also retard any leak past the packing gland 16 since the gland, itself is open to the bellows 35.

As the piston 20 moves upwardly, the compressed air progressively returns to atmospheric condition and, with continued travel, may generate a slight vacuum; however, eventually the ring 45 will lift from the upper surface of the spacer ring 38 whereby the air pressure in bellows 35 is equalized with the ambient pressure by the influx of air through the passageways 40. The generation of a slight vacuum is advantageous since it assures that the bellows 35 will be returned to its full height.

Should the gland box 16 leak or cup 26 overflow, the hydraulic oil, liquid or fluid may flow down the outside periphery of the gland box 16 and into the cup 18. This, in turn, will flow into a removable cup (not shown) arranged to receive the overflow, in the usual way.

Since as the piston 20 reciprocates, the recess or cup 26 confines the leaked liquid, this liquid will be held adjacent to the periphery of piston rod 20 and coat or lubricate piston 20, continuously.

It will be obvious to those skilled in the art that many variations may be made in the embodiment here chosen for the purpose of illustrating the present invention, without departing from the scope thereof as defined by the appended claims.

We claim:

1. A hydraulic cylinder assembly of the type having an upright cylinder member with a piston rod protruding from the upper end of said cylinder member and wherein said piston rod is extended and retracted in said cylinder member and liquid within said cylinder member may leak out of said end of said cylinder member when said piston rod is moved by the hydraulic liquid, and wherein the improvement comprises:

(a) the upper end portion of said cylinder member being provided with a recess for receiving the liquid which has leaked and for confining the leaked liquid adjacent to the outer periphery of said piston rod;

(b) a compressible bellows adjacent to said piston rod, said bellows having a normal position in which the air in said bellows is at ambient pressure, said bellows communicating with said recess for applying air pressure to said leaked liquid in said recess when said bellows is depressed from its normal position;

(c) means for compressing said bellows from its normal position during only a portion of the stroke of said piston rod;

(d) means for directing said leaked liquid from said recess and away from said piston rod when air pressure is applied to said leaked liquid by said air pressure; and (e) there being provided an opening for introducing ambient air into said bellows when the pressure within said bellows has been reduced below the pressure of the ambient air.

2. The hydraulic cylinder assembly defined in claim 1 wherein said depressible bellows is a hollow bellows surrounding said piston rod and said recess.

3. The hydraulic cylinder assembly defined in claim 2 wherein said recess is an upwardly opening recess surrounding said piston rod and opening into the bottom portion of said bellows.

4. The hydraulic cylinder assembly defined in claim 2 wherein said bellows is provided with means at the upper end of said bellows for permitting said piston rod to reciprocate axially with respect to the upper end portion of said bellows and means for closing said bellows to the ambient air during the period in which said bellows is depressed by movement of said piston rod.

5. The hydraulic cylinder assembly defined in claim 1 wherein said bellows is a cylindrical bellows surrounding said piston rod, the lower end of said bellows being secured to the upper end portion of said cylinder member, said recess surrounding said piston rod, said means for depressing said bellows also including means for closing said bellows to the ambient air during the period in which it is depressed.

6. The hydraulic cylinder assembly defined in claim 5 including a ball check valve disposed between said recess and said means for directing said leaked liquid from said recess and away from said piston rod.

7. The hydraulic cylinder assembly defined in claim 1 wherein said bellows surround said piston rod and wherein the bottom portion of said bellows is connected to the upper end portion of said cylinder member, said bellows having an upper end terminating below the upper end of said piston rod, when said piston rod is in its lowermost position, and wherein said means for depressing said bellows includes a ring extending around an intermediate portion of said piston rod and reciprocated therewith, toward and away from the upper end of said bellows, said ring being aligned axially with the upper end of said bellows and being spaced from the upper end of said bellows during a portion of the stroke of said piston rod, said ring engaging and compressing said bellows during the lowermost portion of the stroke of said piston rod.

8. The hydraulic cylinder assembly defined in claim 1 wherein said bellows surround said piston rod and wherein the bottom portion of said bellows is connected to the upper end portion of said cylinder member, a ring at the upper end of said bellows for spacing said upper end away from said piston rod and for providing an air passageway between said piston rod and said bellows, and a sealing ring connected to an intermediate portion of said piston rod and recriprocated therewith, toward and away from said upper end of said bellows, said sealing ring sealing the air passageway between said bellows and said piston rod, during a portion of the inward movement of said piston rod in said cylinder, said sealing ring compressing said bellows as said piston rod is further moved inwardly into said cylinder member.

9. The hydraulic cylinder assembly defined in claim 1 wherein said cylinder member includes a hydraulic cylinder and a gland box at the end of said cylinder, said gland box and said hydraulic cylinder being coaxially arranged around said piston rod, said bellows surrounding said piston rod and having its lower end received around the upper end portion of said gland box, said recess being an upwardly opening recess in said gland box and within the lower end of said bellows, said means for directing said leaked liquid from said recess and away from said piston rod, including a ball check valve disposed in said gland box and communicating with said recess and the exterior of said gland box, a tube on the exterior of said gland box leading from said ball check valve and away from said piston rod, said means for compressing said bellows including a compression ring carried for reciprocation by an intermediate portion of said piston rod and outwardly of said upper end of said bellows, said bellows having its upper end normally open to the atmosphere, said sealing ring closing upper end of said bellows during a portion of the downward stroke of said piston rod and thereafter compressing said bellows during the continued downward stroke thereof.

10. An elevator assembly of the type having a cylinder assembly for moving an elevator car, within an elevator shaft, said piston assembly having an upright cylinder and a piston rod protruding from said upright cylinder and wherein said piston rod is extended and retracted in said cylinder and liquid within said cylinder may leak out of said cylinder when the piston rod is moved by hydraulic liquid within said cylinder, the improvement comprising:

(a) a liquid receiving member surrounding the lower portion of said piston rod for having a recess for receiving liquid which has leaked from the junction of said piston rod and said cylinder;

(b) a compressible bellows surrounding said piston rod and said liquid receiving member and communicating with said recess for applying air pressure to said leaked liquid in said recess when said bellows is compressed;

(c) means for compressing said bellows during a portion of the stroke of said piston rod; and (d) means for directing said leaked liquid from said recess and away from said piston rod when pressure is applied to said leaked liquid by said air pressure.

11. A hydraulic elevator assembly of the type having an upright cylinder supported by a floor with a piston rod protruding from the upper end of said cylinder member and wherein said piston rod is extended and retracted in said cylinder member for raising and lowering an elevator platform and liquid within said cylinder member may leak out of said end of said cylinder member when said piston rod is moved by the hydraulic liquid, and wherein the improvement comprises:

(a) the upper end portion of said cylinder member being provided with an upwardly opening recess for receiving the liquid which has leaked and for confining the leaked liquid adjacent to the outer periphery of said piston rod;

(b) compressed air applying member defining an interior chamber surrounding said recess and a portion of said piston rod above said recess, the chambers of said compressed air applying member being open to the ambient air, and communicating with said recess;

(c) means moveable with said piston rod for closing the chamber of said compressed air applying means to the ambient air when said piston rod approaches as retracted position, and for thereafter compressing the air within said chamber for applying the air under pressure in the chamber to said leaked liquid in said recess when said piston rod is retracted further; and (d) means for directing said leaked liquid from said recess and away from said piston rod when air pressure is applied to said leaked liquid.

* * * * *